US010568802B2

(12) United States Patent
Zake

(10) Patent No.: US 10,568,802 B2
(45) Date of Patent: Feb. 25, 2020

(54) FOOT THERAPY DEVICE

(71) Applicant: YZ STUDIO, INC., New York, NY (US)

(72) Inventor: Yamuna Zake, New York, NY (US)

(73) Assignee: YZ Studio, Inc., New York, NY (US)

( * ) Notice: Subject to any disclaimer, the term of this patent is extended or adjusted under 35 U.S.C. 154(b) by 830 days.

(21) Appl. No.: 15/167,438

(22) Filed: May 27, 2016

(65) Prior Publication Data

US 2017/0340508 A1 Nov. 30, 2017

(51) Int. Cl.
*A61H 7/00* (2006.01)

(52) U.S. Cl.
CPC ..... *A61H 7/002* (2013.01); *A61H 7/001* (2013.01); *A61H 2201/1284* (2013.01); *A61H 2201/168* (2013.01); *A61H 2205/12* (2013.01)

(58) Field of Classification Search
CPC .. A61H 7/002; A61H 7/001; A61H 2201/168; A61H 2201/1284; A61H 2205/12
See application file for complete search history.

(56) References Cited

U.S. PATENT DOCUMENTS 4,126,129 A * 11/1978 Rainbow ..... A61H 1/00 601/134
5,096,188 A * 3/1992 Shen ..... A61H 7/001 482/51
5,843,005 A * 12/1998 Chubinsky ..... A61H 7/003 601/15
7,320,668 B1 * 1/2008 Warder ..... A61H 7/001 601/136
2003/0195440 A1 * 10/2003 Zake ..... A61H 15/00 601/27
2004/0230146 A1 * 11/2004 Chang ..... A43B 7/1465 601/134
2009/0030354 A1 * 1/2009 Ghatge ..... A61H 15/00 601/134
2016/0113837 A1 * 4/2016 Burson ..... A61H 15/0092 601/118

* cited by examiner

*Primary Examiner* — Quang D Thanh
(74) *Attorney, Agent, or Firm* — Ferdinand IP Law Group

(57) ABSTRACT

A foot therapy device includes a generally hemispherical dome element detachably connected to a support element having substantially planar top and bottom faces. In some embodiments, the support element is optionally detachably connected to one or more additional stacked support elements.

16 Claims, 5 Drawing Sheets

FOOT THERAPY DEVICE

COPYRIGHT NOTICE

A portion of the disclosure of this patent document contains material that is subject to copyright protection. The copyright owner has no objection to the facsimile reproduction by anyone of the patent document or the patent disclosure as it appears in the Patent and Trademark Office patent files or records, but otherwise reserves all copyrights whatsoever.

FIELD OF THE INVENTION

This invention relates to a device and system for foot therapy.

BACKGROUND

The human foot is a complex structure of many bones, muscles and nerves for complex functions supporting and providing information to the body. Foot therapy therefore includes therapy for both foot and body structures, and can help prevent many common injuries through improving alignment and flexibility.

SUMMARY

Generally speaking, a foot therapy device comprises a generally hemispherical dome element detachably connected to a support element having substantially planar top and bottom faces. In embodiments, the support element is optionally detachably connected to one or more additional support elements.

BRIEF DESCRIPTION OF THE DRAWINGS

Embodiments are illustrated in the figures of the accompanying drawings, which are meant to be exemplary and not limiting, and in which like references are intended to refer to like or corresponding things.

DETAILED DESCRIPTION OF THE PREFERRED EMBODIMENTS

Figure 1:
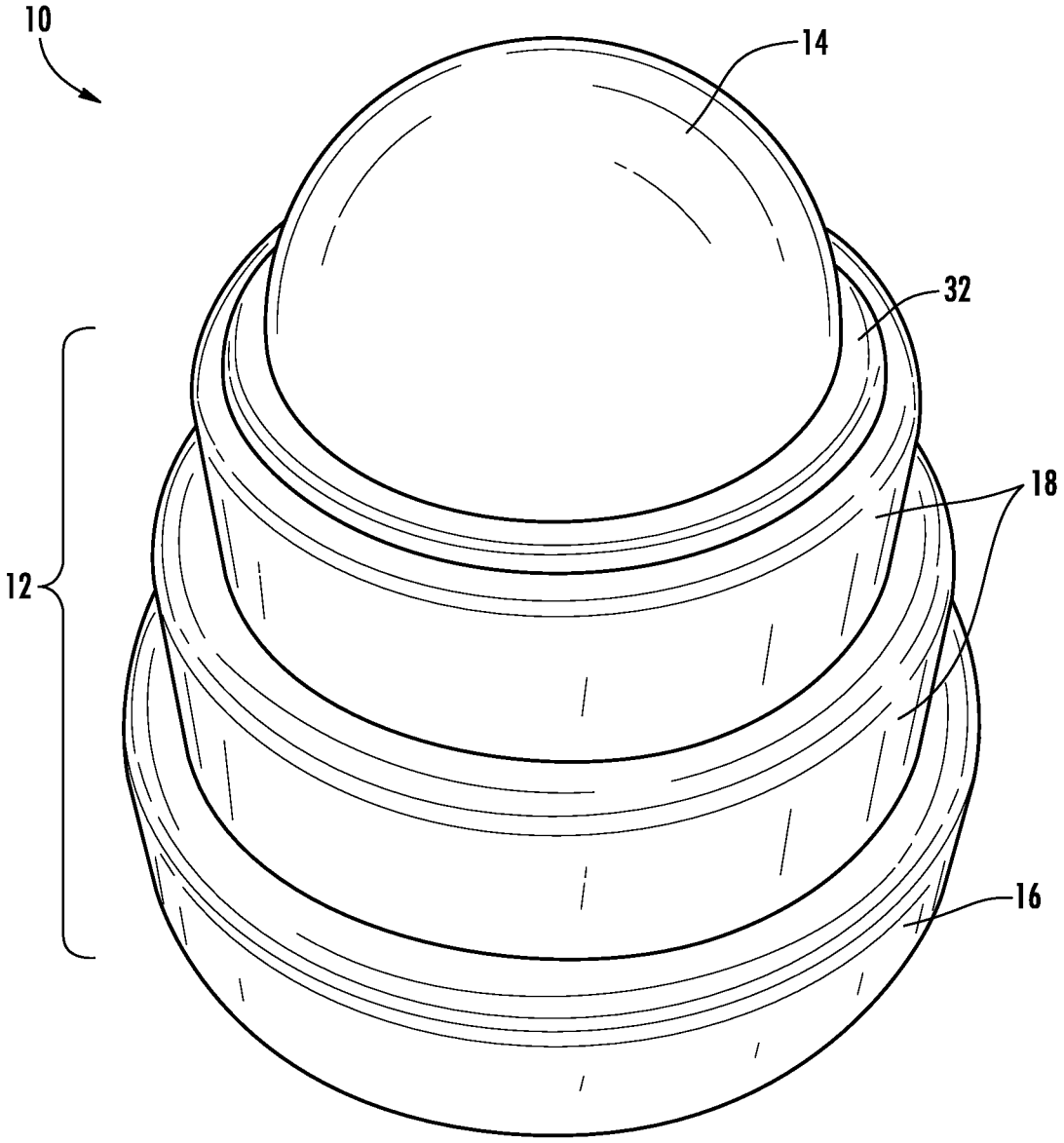
FIG. 1 is a perspective view of an embodiment of a foot therapy device.
Figure 2:
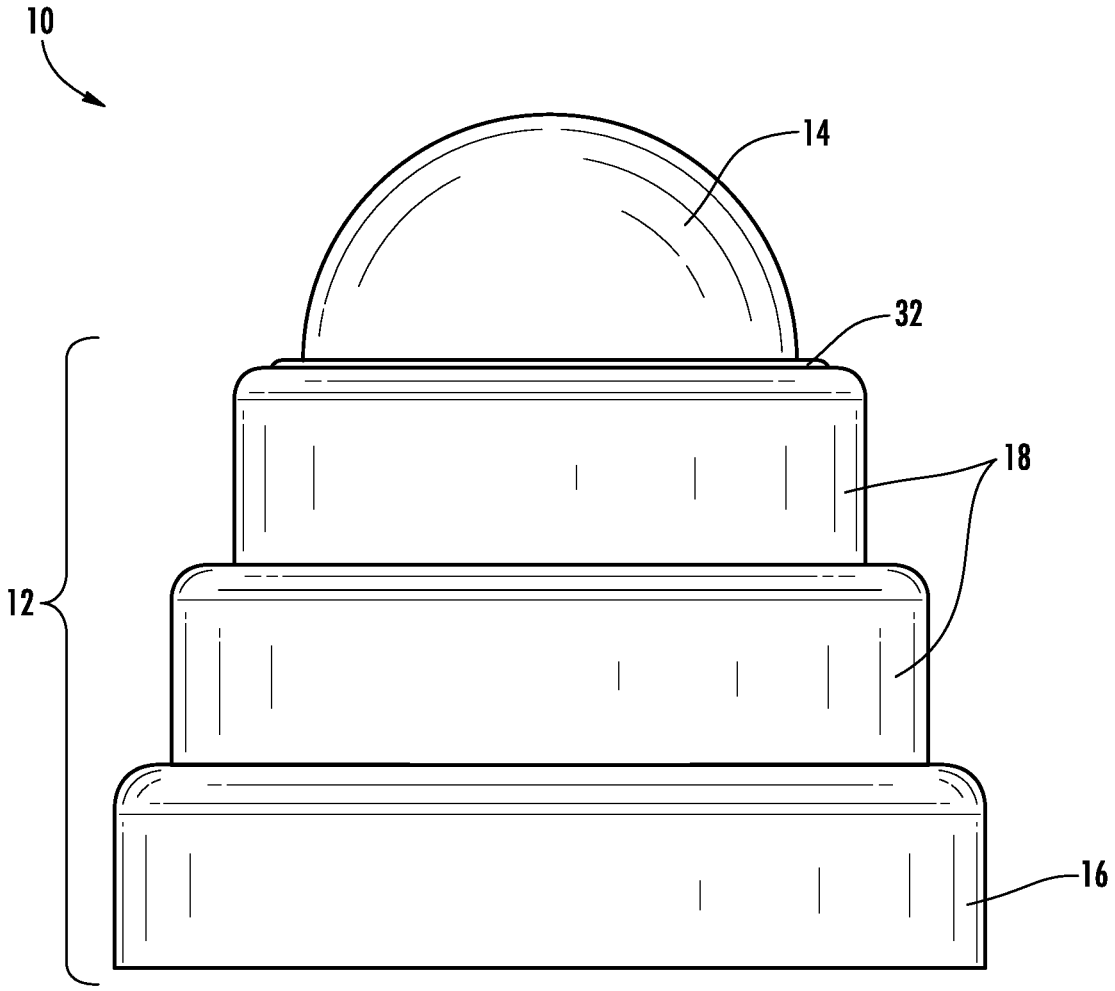
FIG. 2 a front view thereof.

Referring to the drawings, FIGS. 1 and 2 show an embodiment of a foot therapy device 10 comprising a dome element 14 located on top of a foundation 12. The dome 14 is of a generally hemispherical shape, and in embodiments includes a rim structure 32 at the bottom of the hemisphere. The bottom of the dome 14 is generally planar and circular.

The foundation 12 comprises a base element 16. In embodiments, the foundation 12 comprises one or more intermediate portions 18 in addition to the base 16. Intermediate portions 18 are stacked on top of the base 16 such that the dome 14 is immediately on top of the uppermost intermediate portion 18. In the embodiment shown, base 16 and intermediate portions 18 of the foundation 12 are generally cylindrical in shape.

In some embodiments having both a base 16 and one or more intermediate portions 18, the planar dimensions of the base 16 and any intermediate portions 18 are generally of the same size. For example, in these such embodiments where the base 16 and intermediate portions 18 are generally cylindrical, the diameters of the base 16 and intermediate portions 18 would be generally the same. In other embodiments, it may be desirable for the planar dimension or diameter of base 16 to be greater than the diameter of an intermediate portion 18. This would provide greater stability to the foundation 12. Furthermore, in some embodiments having a plurality of intermediate portions 18, each stacked intermediate portion 18 has a diameter that is smaller than any intermediate portion 18 below it, as in the embodiment shown in FIGS. 1 and 2.

Figure 3:
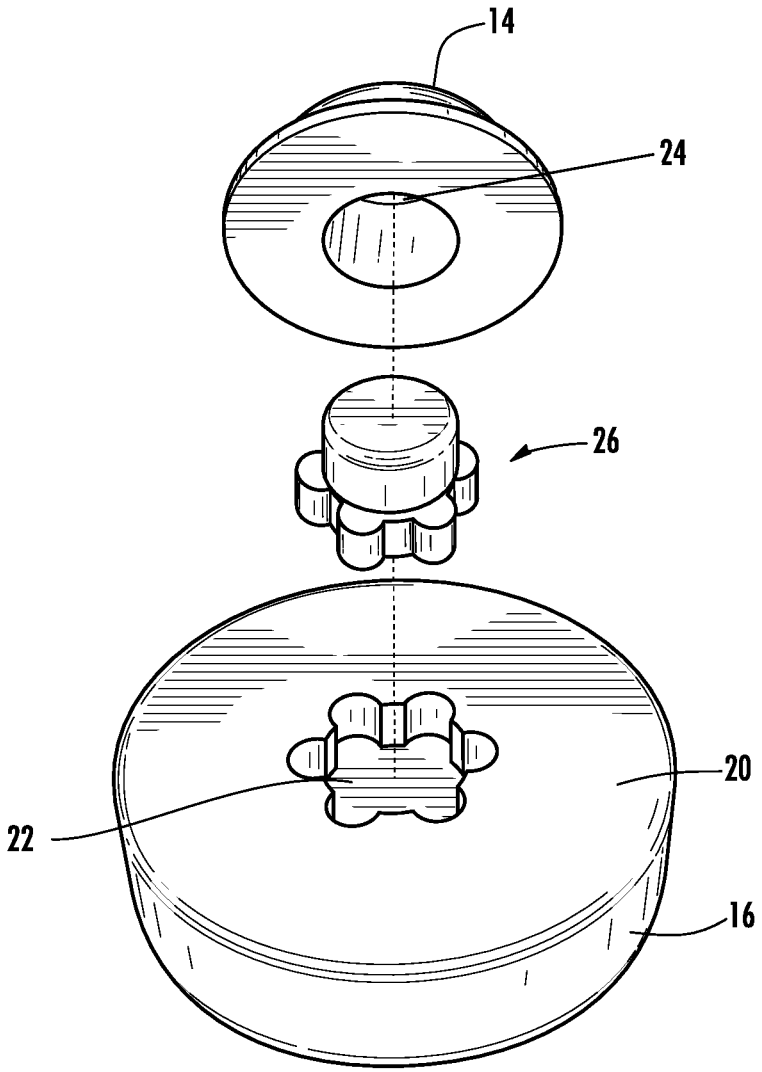
FIG. 3 is a perspective view of an embodiment of a foot therapy device, where components have been separated.

As seen in FIG. 3, the dome 14 has a central cavity 24. In the embodiment shown, the top face 20 of the base 16 is generally planar, and has an indentation 22 located generally centrally within the top face 20. In order to detachably connect the dome 14 to the base 16, a plug 26 is adapted to fit snugly into both the base indentation 22 and the dome cavity 24. In this way, the dome 14 and the base 16 can be attached together using the plug 26 and then detached simply by pulling the dome 14 and base 16 apart.

In an alternative embodiment, the plug 26 is an integrated portion of the base 16. That is, the base 16 has a central protrusion adapted to fit directly into the dome cavity 24. In this embodiments, the base has no indentation 22, and the dome 14 attaches directly to the base 16 without the use of a separate plug 26.

Figure 4:
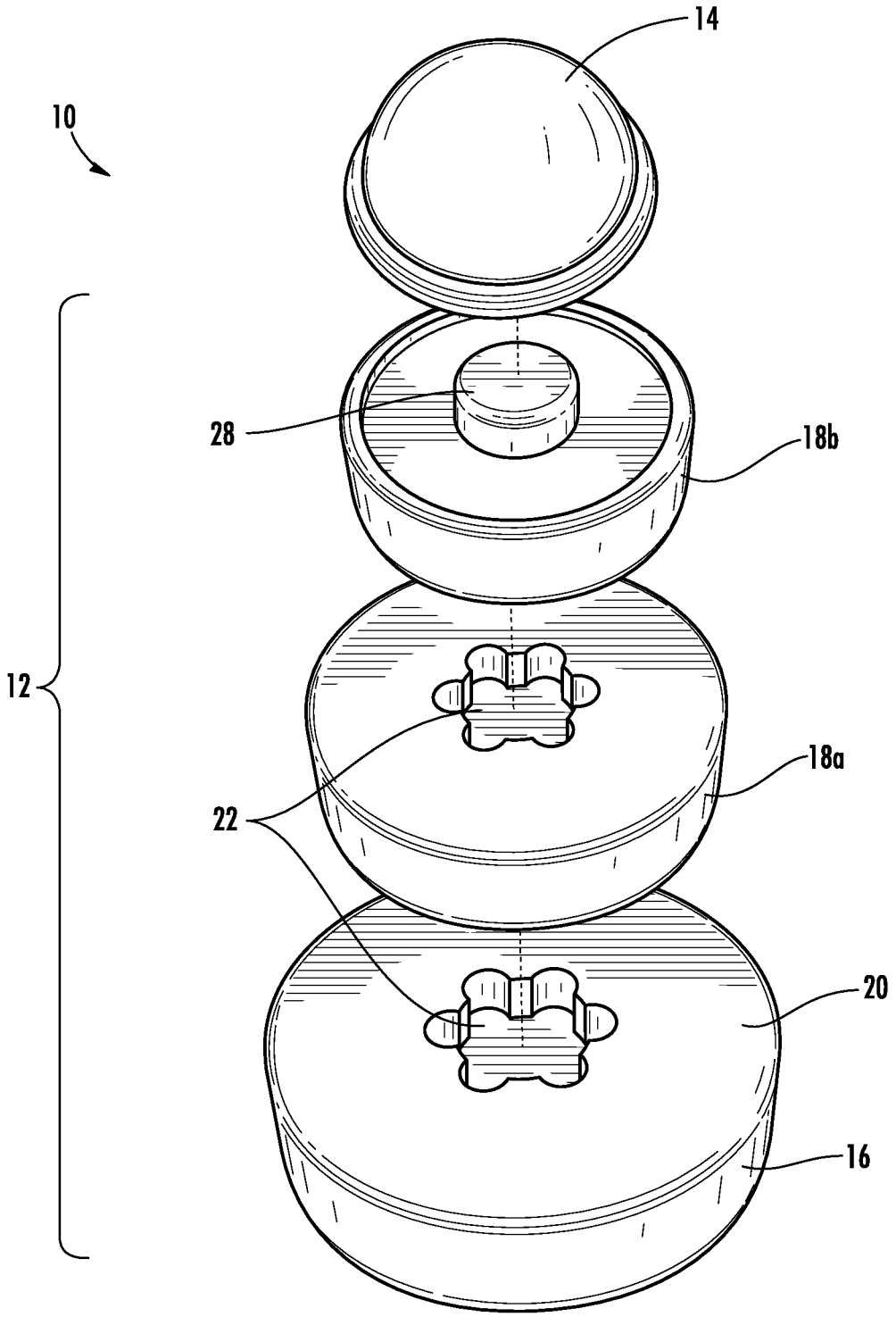
FIG. 4 is a perspective view of an embodiment of a foot therapy device, showing separated components.
Figure 5:
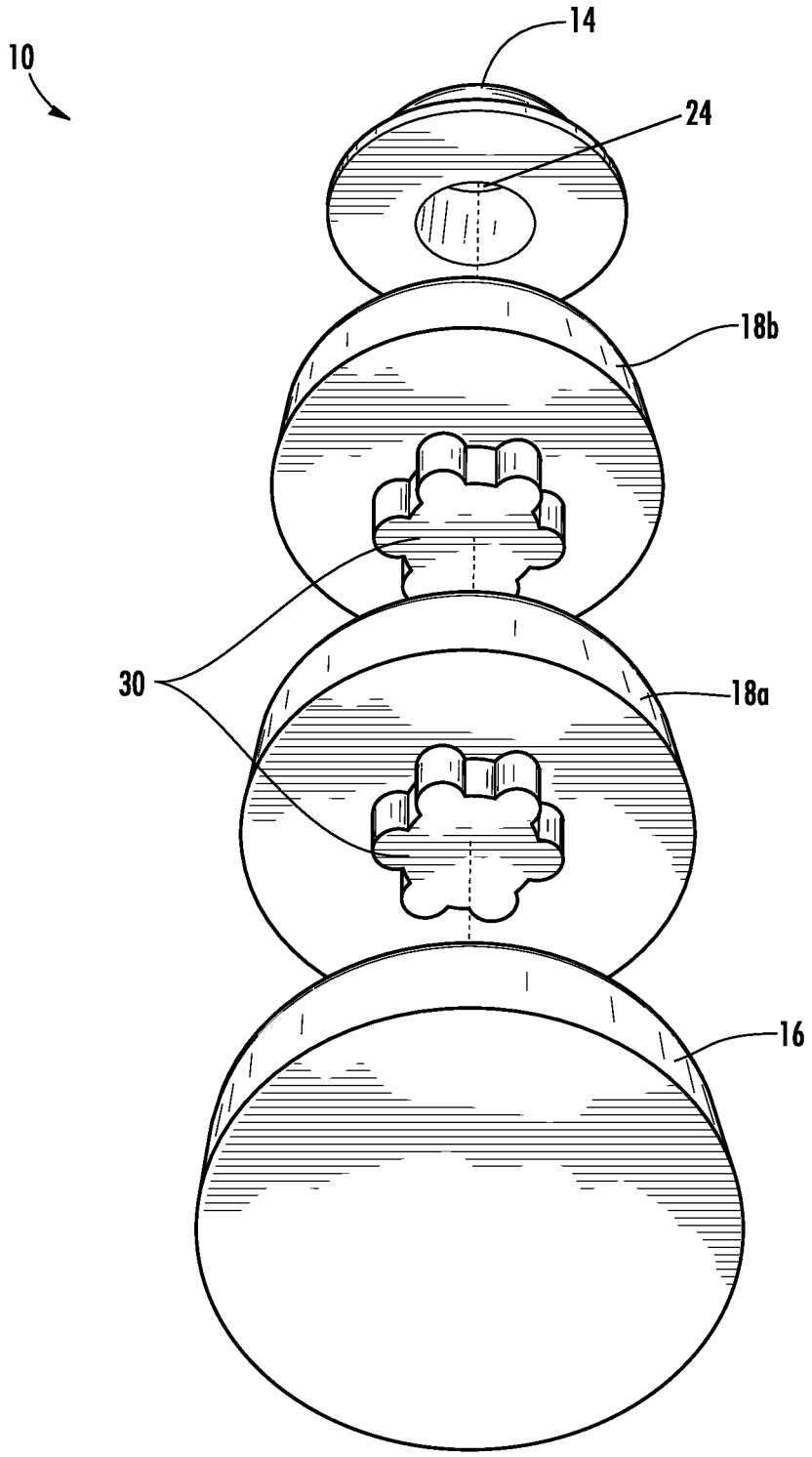
FIG. 5 is an alternate perspective view thereof.

FIGS. 4 and 5 show an embodiment of the foot therapy device 10 in which the foundation 12 comprises a base 16 and two intermediate portions 18*a* and 18*b*. The base 16 and intermediate portion 18*a* each have an indentation 22 used to receive a connector 30 from the element immediately above it. Connectors 30 are integrated into intermediate portions 18*a* and 18*b* and are adapted to fit snugly within indentations 22. In this way, elements of the foundation 12 are attached by engaging connectors 30 with indentations 22 and pressing the elements together. In turn, they are detached by pulling the elements apart.

In embodiments where all intermediate portions 18 have an indentation 22, a plug 26 will be required to attach the dome 14 to the uppermost intermediate portion 18. However, in the embodiment shown in FIGS. 4 and 5, intermediate portion 18*b* shows an alternative embodiment in which the plug 26 is integrated into an intermediate portion 18. In this way, the intermediate portion 18*b* has a central protrusion 28 adapted to fit directly into the dome cavity 24 without the use of a separate plug 26. It should be appreciated that in embodiments where any element of the foundation 12 has a protrusion 28 rather than an indentation 22, any element placed immediately on top of the protrusion 28 has a corresponding cavity in place of a connector 30.

The embodiment shown in FIGS. 1, 2, 4, and 5 comprise a base 16 and two intermediate portions 18. However, other embodiments can have any number of intermediate portions 18 or no intermediate portion at all without departing from the spirit and scope of the invention.

Additionally, in the embodiments shown, indentation 22 is a modified hexafoil shape. However, it should be appreciated that the indentation 22 can be of any suitable size and shape, including but not limited to round, oval, square, rectangular, donut, triangular, or irregular. Accordingly, the shape of any plug 26 or connectors 30 will be adapted to correspond with the shape of the indentation 22 as well as any cavity 24.

In the embodiments shown, the sides of the base 16 and intermediate portions 18 are substantially perpendicular to the ground. In other embodiments, the sides of these components can be curved, inclined, or of any other suitable shape.

In embodiments, the foot therapy device is primarily made of a resilient material that compresses and/or deforms but does not collapse under average and/or normal human body weight, such as plastic and/or rubber. The cavity 24 of the dome 14 additionally provides a dome 14 structure that prevents collapse under deformation pressure.

It should be understood that the dimensions of the different components may vary. However, it has been found that an embodiment of the foot therapy device functions as described where the components have dimensions as follows, where all measurements are in centimeters: (a) Dome—the diameter is approximately in the range of 5 cm to 9 cm, with a height approximately in the range of 2 cm to 5 cm, the cavity has a diameter of approximately 2 cm to 4 cm and a depth of 3 cm to 8.9 cm; (b) Upper intermediate portion—the diameter is approximately in the range of 6 cm to 10 cm, with a height approximately in the range of 1 cm to 3 cm, the protrusion has a diameter of approximately 2 cm to 4 cm and a height of approximately 0.5 cm to 3 cm; (c) Lower intermediate portion—the diameter is approximately in the range of 7 cm to 11 cm, with a height approximately in the range of 1 cm to 3 cm, the indentation has a diameter of approximately 2 cm to 4 cm and a depth of approximately 0.5 cm to 2.9 cm; and (d) Base—the diameter is approximately in the range of 8 to 12 cm, with a height approximately in the range of 1 cm to 3 cm, the indentation has a diameter of approximately 2 cm to 4 cm and a depth of approximately 0.5 cm to 2.9 cm.

A method of using the device relates to the structure of the foot. A user's feet may be pressed on the device 10 individually or, preferably, together using one device for each foot. Where both feet are pressed on the device at the same time, a pair of the devices are placed on the floor preferably hip width apart, or approximately 8-10 inches. However, as the method of use for two feet is the same as for one foot, only one foot will be described.

The device 10 is placed on the floor and the user positions the foot such that the dome 14 sits just in front of the heel, on the midline of the foot. The heel is pressed downward preferably from a standing position and preferably for at least 15 seconds. If this is too painful it can be done with one foot at a time, leaning against a wall, and/or holding onto a tabletop or the back of a chair for support. The user can optionally press and release each toe slowly into the ground. The foot is then shifted to position the dome 14 to the lateral (outside) portion of the foot just in front of the heel and the same actions are repeated. The foot is then shifted to position the dome 14 to the medial (inside) portion of the foot just in front of the heel and the same actions are repeated.

For a user performing the toe press and release method on the device, toes are worked corresponding to the side of the heel pressed into the device. For example, when the device is centered, all of the toes can be exercised; when the device is shifted to the medial side of the foot, the user's big toe can be exercised; and when the device is shifted to the lateral side, the toes closest to the outside of the foot can be exercised. Focusing exercise on the toes in this way strengthens the toes, feet, calves and thighs.

The most basic configuration of the device uses an embodiment comprising the base 16 and the dome 14 without any intermediate portions 18. Once the user is comfortable in this configuration, she adds an intermediate portion 18 to raise the dome 14 higher off the ground. This provides a greater stretch to the user's foot. The user can continue to add intermediate portions 18 to increase the height of the dome 14 and the corresponding stretch to the foot. With each increase in height, the user's feet, legs, hips and spine relax and improve their alignment and flexibility.

The effect of therapy using the device 10 is to promote separation of the heel from the rest of the foot to encourage bones, tendons, muscles and ligaments to stretch out through the foot. This allows tendons and muscles the space to reach their insertions in the toes. Several muscles descend from the leg, crossing just in front of the medial heel. By stretching the heels back using the foot therapy device 10, space is created for the muscles in the leg to lengthen and fully descend through the medial side of the foot and reach their insertions in the toes.

Due to common ailments such as fallen arches, poor posture, flat feet, and pronation, excess weight often falls to the inner foot. Additionally, wearing constrictive shoes or high heels can hinder the foot's proper stretch and alignment. As a consequence, the plantar fascia gets stuck to the tendons and inhibits the tendons of the muscles from reaching the toes. This is a structural hindrance to proper muscle function.

Using this device after wearing high heels can prevent injuries, re-stretch feet after high heel use, and counteract negative effects that accrue from wearing high heels. Using this device, women can continue to wear high heels without injury to the feet or posture.

Additionally, use of the device 10 strengthens the toes and feet because as the heels are pulled back, there is space for each toe and their corresponding muscles to develop strength and flexibility.

This is particularly important in dance or other athletic training to prevent potentially dire foot and ankle injuries. By correctly training the feet to develop strength and flexibility, the strength and flexibility of muscle chains of the legs and thighs is also improved.

In particular, athletics and fitness training are typically done with shoes on, which compromises the ability to fully train the muscles throughout all muscle chains. Plantar fasciitis, Achilles tendon ruptures, and other foot problems are quite common. Therapy using the foot therapy device 10 could help to prevent these problems. In addition to preventing injury, therapy using the device 10 provides users with improved posture and weight distribution for all users.

The particular embodiments disclosed above are illustrative only, as the invention may be modified and practiced in different but equivalent manners apparent to those skilled in the art having the benefit of the teachings herein. For example, while the shape of intermediate portions 18 and base 16 are shown to be generally cylindrical, it should be understood that each of these components could also be another shape such as square, rectangular, hexagonal, octagonal, or another suitable shape to provide adequate support for the dome 14. In another embodiment, the single, centrally located connecting plugs, connectors, indentations or protrusions for each of the intermediate portions 18 and base 16 could be replaced with one, two, or more plugs, connectors, indentations or protrusions of the same or different shapes that are off-center. Additional tiered intermediate portions may also be included. In another embodiment, any intermediate portions 18 and the base 16 can be of the same diameter.

It should be understood that no limitations are intended to the details of construction or design herein shown, other than as described in the claims below. It is therefore evident that the particular embodiments disclosed above may be altered or modified and all such variations are considered within the scope and spirit of the invention.

The invention claimed is:

1. A foot therapy device comprising:

a first support having a substantially planar top face and a bottom face;

a first indentation disposed on the top face of the first support, wherein a depth of the first indentation is less than a height of the first support;

a dome having a hemispherical top and a substantially planar base;

the dome having a central cavity extending up from the base;

a plug adapted to simultaneously fit snugly into the central cavity and the first indentation such that the first support, the plug, and the dome are detachably connected by pressing together;

a second support having a substantially planar top face and a bottom face;

a second indentation disposed on the top face of the second support, wherein a depth of the second indentation is less than a height of the second support;

wherein the first support has a protrusion disposed on the bottom face of the first support configured to fit snugly into the second indentation of the second support;

and wherein the first and second supports are detachably connected by aligning the protrusion of the first support with the second indentation of the second support and pressing together.

2. The foot therapy device of claim 1, wherein the first support is substantially cylindrical.

3. The foot therapy device of claim 1, wherein the first indentation of the first support is centrally located in the top face of the first support.

4. The foot therapy device of claim 1, wherein the dome is made of a resilient material that compresses and/or deforms but does not collapse.

5. The foot therapy device of claim 1, wherein the second indentation of the second support is centrally located in the top face of the second support.

6. The foot therapy device of claim 1, wherein the protrusion of the bottom face of the first support is centrally located.

7. The foot therapy device of claim 1, wherein the top face of the second support is larger than the top face of the first support.

8. The foot therapy device of claim 1, wherein the top face of the first support is of a shape selected from the group comprising oval, triangular, square, rectangular, hexagonal, or octagonal.

9. The foot therapy device of claim 1, wherein one of the first and second indentations is of a shape selected from the group comprising round, oval, square, rectangular, donut, triangular, or irregular.

10. A foot therapy device comprising:

a dome having a hemispherical top and a substantially planar base;

the dome having a central cavity extending up from the base;

a first support having a substantially planar top face and a bottom face;

the top face having a generally central first protrusion disposed on a surface of the top face and adapted to fit snugly into the central cavity;

wherein the first support and the dome are detachably connected by aligning the central first protrusion to the central cavity and pressing together;

a second support having a substantially planar top face and a bottom face;

the top face of the second support having an indentation;

wherein the first support has a second protrusion disposed on a surface of the bottom face of the first support and configured to fit snugly into the indentation of the second support;

and wherein the first and second supports are detachably connected by aligning the second protrusion of the first support with the indentation of the second support and pressing together.

11. The foot therapy device of claim 10, wherein the top face of the first support is larger than the base of the dome.

12. The foot therapy device of claim 10, wherein the first support is generally cylindrical.

13. The foot therapy device of claim 10, wherein the top face of the second support is larger than the top face of the first support.

14. The foot therapy device of claim 10, wherein the second support is generally cylindrical.

15. The foot therapy device of claim 10, wherein the dome is made of a resilient material that compresses and/or deforms but does not collapse.

16. The foot therapy device of claim 10, wherein the top face of the first support is of a shape selected from the group comprising oval, triangular, square, rectangular, hexagonal, or octagonal.

* * * * *